US009174476B2

(12) United States Patent
Sugino et al.

(10) Patent No.: US 9,174,476 B2
(45) Date of Patent: Nov. 3, 2015

(54) RIBBON GUIDE IN A TAPE CASSETTE

(75) Inventors: Tomohiko Sugino, Nagoya (JP); Yasuhiro Shibata, Nagoya (JP); Takashi Horiuchi, Nagoya (JP); Tsutomu Kato, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 367 days.

(21) Appl. No.: 13/028,366

(22) Filed: Feb. 16, 2011

(65) Prior Publication Data

US 2011/0211894 A1 Sep. 1, 2011

(30) Foreign Application Priority Data

Feb. 26, 2010 (JP) ..... 2010-041323

(51) Int. Cl.

| | |
|---|---|
| ***B41J 17/28*** | (2006.01) |
| ***B41J 32/00*** | (2006.01) |
| ***B41J 33/00*** | (2006.01) |
| ***B41J 33/02*** | (2006.01) |
| ***B41J 33/04*** | (2006.01) |
| ***B41J 35/06*** | (2006.01) |

(52) U.S. Cl.

CPC *B41J 32/00* (2013.01); *B41J 33/00* (2013.01); *B41J 33/02* (2013.01); *B41J 33/04* (2013.01); *B41J 35/06* (2013.01)

(58) Field of Classification Search

CPC ..... B41J 35/04; B41J 35/06; B41J 32/00; B41J 33/02; B41J 33/04; B41J 33/00; B41J 17/30; B41J 17/28

USPC ..... 400/207, 613, 88

See application file for complete search history.

(56) References Cited

U.S. PATENT DOCUMENTS

| | | | | |
|---|---|---|---|---|
| 4,127,883 | A | 11/1978 | Mestdagh | |
| 4,319,850 | A * | 3/1982 | Rello et al. | 400/247 |
| 4,567,488 | A | 1/1986 | Moriguchi et al. | |
| 4,657,418 | A * | 4/1987 | Lahr | 400/229 |

(Continued)

FOREIGN PATENT DOCUMENTS

| | | |
|---|---|---|
| CN | 1830677 | 9/2006 |
| EP | 0329369 A2 | 8/1989 |

(Continued)

OTHER PUBLICATIONS

Notification of reasons for rejection issued in the related Japanese Application No. 2009-088241, Nov. 15, 2011, JPO, Japan.

(Continued)

*Primary Examiner* — Jennifer Simmons

(74) *Attorney, Agent, or Firm* — McCarter & English, LLP

(57) ABSTRACT

A tape cassette includes a first guide member provided between a feed portion and a discharge slot, and positioned on or immediately before the discharge slot, on an upstream side in a travel direction of a ink ribbon, wherein the first guide member bends and guides travel of the ink ribbon in the predetermined direction while making contact with a reverse side of a inked surface of the ink ribbon and a second guide member provided between the feed portion and the discharge slot, and positioned on an upstream side in the travel direction of the ink ribbon with respect to the first guide member, wherein the second guide member bends and guides the travel of the ink ribbon in the predetermined direction while making contact with the reverse side of the inked surface of the ink ribbon.

6 Claims, 5 Drawing Sheets

(56) References Cited

U.S. PATENT DOCUMENTS

| | | | |
|---|---|---|---|
| 4,880,325 | A | 11/1989 | Ueda et al. |
| 4,892,425 | A | 1/1990 | Shimizu et al. |
| 4,915,516 | A | 4/1990 | Shimizu et al. |
| 4,927,278 | A | 5/1990 | Kuzuya et al. |
| 4,983,058 | A | 1/1991 | Nagae |
| 5,188,469 | A | 2/1993 | Nagao et al. |
| 5,203,951 | A | 4/1993 | Hattori et al. |
| 5,223,939 | A | 6/1993 | Imaizumi et al. |
| RE34,521 | E | 1/1994 | Shimizu et al. |
| 5,277,503 | A | 1/1994 | Nagao |
| 5,348,406 | A | 9/1994 | Yoshiaki et al. |
| 5,350,243 | A | 9/1994 | Ichinomiya et al. |
| 5,374,132 | A | 12/1994 | Kimura |
| 5,411,339 | A | 5/1995 | Bahrabadi et al. |
| 5,419,648 | A | 5/1995 | Nagao et al. |
| 5,429,443 | A | 7/1995 | Kobayashi et al. |
| 5,466,076 | A | 11/1995 | Kobayashi et al. |
| 5,494,362 | A | 2/1996 | Kobayashi et al. |
| 5,538,352 | A | 7/1996 | Sugiura |
| 5,540,510 | A | 7/1996 | Sims et al. |
| 5,564,843 | A | 10/1996 | Kawaguchi |
| 5,593,237 | A | 1/1997 | Nozaki et al. |
| 5,620,268 | A | 4/1997 | Yamaguchi et al. |
| 5,653,542 | A | 8/1997 | Sugimoto et al. |
| 5,659,441 | A | 8/1997 | Eckberg et al. |
| 5,727,888 | A | 3/1998 | Sugimoto et al. |
| 5,730,536 | A | 3/1998 | Yamaguchi |
| 5,771,803 | A | 6/1998 | Takami |
| 5,813,773 | A | 9/1998 | Kawai |
| 5,825,724 | A | 10/1998 | Matsumoto et al. |
| 5,964,539 | A | 10/1999 | Yamaguchi et al. |
| 6,042,280 | A | 3/2000 | Yamaguchi et al. |
| 6,048,118 | A | 4/2000 | Martinez et al. |
| 6,059,469 | A | 5/2000 | Hirumi |
| 6,116,796 | A | 9/2000 | Yamaguchi et al. |
| 6,132,120 | A | 10/2000 | Yamaguchi et al. |
| 6,168,328 | B1 | 1/2001 | Ueda et al. |
| 6,190,069 | B1 | 2/2001 | Yamaguchi et al. |
| 6,196,740 | B1 | 3/2001 | Yamaguchi et al. |
| 6,317,156 | B1 | 11/2001 | Nagasaki et al. |
| 6,334,724 | B2 | 1/2002 | Yamaguchi et al. |
| 6,406,202 | B1 | 6/2002 | Unno et al. |
| 6,435,744 | B1 | 8/2002 | Dunn et al. |
| 6,476,838 | B1 | 11/2002 | Italiano |
| 6,485,206 | B1 | 11/2002 | Takahashi |
| 6,520,696 | B2 | 2/2003 | Huss et al. |
| 6,709,179 | B2 | 3/2004 | Yamaguchi et al. |
| 7,121,751 | B2 | 10/2006 | Harada et al. |
| 7,128,483 | B2 | 10/2006 | Harada et al. |
| D534,203 | S | 12/2006 | Harada et al. |
| D542,334 | S | 5/2007 | Harada et al. |
| 7,965,308 | B2 | 6/2011 | Jauert et al. |
| 8,045,288 | B2 | 10/2011 | Ota et al. |
| 8,109,684 | B2 | 2/2012 | Yamaguchi |
| 8,162,553 | B2 | 4/2012 | Vandermeulen |
| 8,164,609 | B2 | 4/2012 | Liu et al. |
| 2002/0006303 | A1 | 1/2002 | Yamaguchi et al. |
| 2002/0012558 | A1 | 1/2002 | Huss et al. |
| 2002/0047063 | A1 | 4/2002 | Kaneda et al. |
| 2004/0233269 | A1 | 11/2004 | Tsubota |
| 2005/0172981 | A1 | 8/2005 | Byun |
| 2006/0198681 | A1* | 9/2006 | Yamamoto ..... 400/120.16 |
| 2006/0204304 | A1 | 9/2006 | Hioki et al. |
| 2006/0233582 | A1 | 10/2006 | Horiuchi |
| 2006/0239743 | A1 | 10/2006 | Naito |
| 2007/0009306 | A1 | 1/2007 | Harada et al. |
| 2007/0041772 | A1 | 2/2007 | Harada et al. |
| 2007/0070168 | A1 | 3/2007 | Mindler et al. |
| 2007/0237562 | A1 | 10/2007 | Kato et al. |
| 2008/0050160 | A1 | 2/2008 | Yamaguchi et al. |
| 2008/0080922 | A1 | 4/2008 | Vandermeulen |
| 2008/0181708 | A1 | 7/2008 | Yamaguchi et al. |
| 2008/0226373 | A1 | 9/2008 | Yamaguchi et al. |
| 2008/0310904 | A1 | 12/2008 | Yamaguchi et al. |
| 2009/0016795 | A1 | 1/2009 | Caveney et al. |
| 2009/0202283 | A1 | 8/2009 | Kumazaki et al. |
| 2011/0058884 | A1 | 3/2011 | Kato et al. |

FOREIGN PATENT DOCUMENTS

| | | | |
|---|---|---|---|
| EP | 0511602 | A1 | 11/1992 |
| EP | 0629509 | | 12/1994 |
| EP | 0644506 | | 3/1995 |
| EP | 0684143 | | 11/1995 |
| EP | 734878 | | 10/1996 |
| EP | 1199179 | | 4/2002 |
| EP | 1284196 | A2 | 2/2003 |
| EP | 1516739 | | 3/2005 |
| EP | 1700705 | | 9/2006 |
| EP | 1707395 | | 10/2006 |
| EP | 2236304 | | 10/2010 |
| JP | 58-139415 | | 9/1983 |
| JP | 6-183117 | | 7/1984 |
| JP | 60-99692 | | 6/1985 |
| JP | 63-166557 | A | 7/1988 |
| JP | 63-203348 | A | 8/1988 |
| JP | 63-254085 | A | 10/1988 |
| JP | 3-093584 | A | 4/1991 |
| JP | 3-120680 | | 5/1991 |
| JP | 3063155 | | 9/1991 |
| JP | 3-118672 | | 12/1991 |
| JP | 4-37575 | | 2/1992 |
| JP | 4-133756 | | 5/1992 |
| JP | 5-16342 | | 3/1993 |
| JP | 5-63067 | | 3/1993 |
| JP | 5-155067 | | 6/1993 |
| JP | 5-54225 | | 7/1993 |
| JP | 5-78565 | | 10/1993 |
| JP | 5-80765 | U | 11/1993 |
| JP | 5-294051 | | 11/1993 |
| JP | 6-12053 | | 2/1994 |
| JP | 6-21953 | U | 3/1994 |
| JP | 6-124406 | | 5/1994 |
| JP | 6-152907 | A | 5/1994 |
| JP | 6-53560 | U | 7/1994 |
| JP | 6-191081 | A | 7/1994 |
| JP | 6-210889 | A | 8/1994 |
| JP | HO6-74348 | | 10/1994 |
| JP | 6-328800 | | 11/1994 |
| JP | 7-1805 | | 1/1995 |
| JP | 7-9743 | | 1/1995 |
| JP | 7-25123 | | 1/1995 |
| JP | 7-47737 | | 2/1995 |
| JP | 7-61009 | | 3/1995 |
| JP | 7-69497 | | 3/1995 |
| JP | 7020725 | | 3/1995 |
| JP | 7-89196 | | 4/1995 |
| JP | 7-101133 | | 4/1995 |
| JP | 7-108702 | A | 4/1995 |
| JP | 7089115 | | 4/1995 |
| JP | 7137327 | | 5/1995 |
| JP | 7-40456 | | 7/1995 |
| JP | 7-237314 | A | 9/1995 |
| JP | 7-251539 | | 10/1995 |
| JP | 7-276695 | A | 10/1995 |
| JP | 7276695 | | 10/1995 |
| JP | 7-290803 | | 11/1995 |
| JP | 7-314864 | | 12/1995 |
| JP | 7-314866 | | 12/1995 |
| JP | HO7-314865 | | 12/1995 |
| JP | 8-25768 | | 1/1996 |
| JP | 8-39909 | | 2/1996 |
| JP | 8-58211 | A | 3/1996 |
| JP | 8-118738 | | 5/1996 |
| JP | 8-252964 | A | 10/1996 |
| JP | 8-267839 | A | 10/1996 |
| JP | 8-290618 | | 11/1996 |
| JP | 2596263 | | 4/1997 |
| JP | 9-134557 | | 5/1997 |
| JP | 9-141986 | A | 6/1997 |
| JP | 9-188049 | | 7/1997 |
| JP | 9-188050 | | 7/1997 |
| JP | 10-056604 | A | 2/1998 |

(56) References Cited

FOREIGN PATENT DOCUMENTS

| | | | |
|---|---|---|---|
| JP | 10-181063 | A | 7/1998 |
| JP | 11-78188 | | 3/1999 |
| JP | 11-105351 | | 4/1999 |
| JP | 11-129563 | | 5/1999 |
| JP | 11-263055 | | 9/1999 |
| JP | 2000-25251 | | 1/2000 |
| JP | 2998617 | | 1/2000 |
| JP | 2000-43336 | | 2/2000 |
| JP | 2000-85224 | | 3/2000 |
| JP | 2000-103129 | | 4/2000 |
| JP | 2000-103131 | | 4/2000 |
| JP | 200-135843 | | 5/2000 |
| JP | 2000-198258 | | 7/2000 |
| JP | 2001-11594 | | 1/2001 |
| JP | 2001-48389 | | 2/2001 |
| JP | 2001-121797 | A | 5/2001 |
| JP | 2001-310540 | | 11/2001 |
| JP | 2001-319447 | | 11/2001 |
| JP | 2002-42441 | | 2/2002 |
| JP | 3266739 | B2 | 3/2002 |
| JP | 2002-104568 | | 4/2002 |
| JP | 2002-179300 | | 6/2002 |
| JP | 2002-308481 | | 10/2002 |
| JP | 2002192769 | | 10/2002 |
| JP | 2002-367333 | | 12/2002 |
| JP | 3357128 | | 12/2002 |
| JP | 2003-048337 | A | 2/2003 |
| JP | 2003-251902 | | 9/2003 |
| JP | 2003-285522 | | 10/2003 |
| JP | 3543659 | | 7/2004 |
| JP | 2004-291591 | | 10/2004 |
| JP | 2004-323241 | | 11/2004 |
| JP | 2005-088597 | A | 4/2005 |
| JP | 2005-231203 | | 9/2005 |
| JP | 2005-280008 | | 10/2005 |
| JP | 2005297348 | | 10/2005 |
| JP | 4061507 | | 11/2005 |
| JP | 2006096030 | | 4/2006 |
| JP | 2006-142835 | | 6/2006 |
| JP | 2006-182034 | | 7/2006 |
| JP | 2006-240310 | A | 9/2006 |
| JP | 2006-248059 | | 9/2006 |
| JP | 2006-272895 | | 10/2006 |
| JP | 2006-272977 | | 10/2006 |
| JP | 2006-289991 | | 10/2006 |
| JP | 2007-196654 | A | 8/2007 |
| JP | 3981706 | | 9/2007 |
| JP | 2007-296863 | | 11/2007 |
| JP | 4003068 | | 11/2007 |
| JP | 4062338 | | 3/2008 |
| JP | 2008-80668 | | 4/2008 |
| JP | 2008-509823 | A | 4/2008 |
| JP | 2008083432 | | 4/2008 |
| JP | 4124235 | | 7/2008 |
| JP | 2008-229855 | A | 10/2008 |
| JP | 2009-28976 | | 2/2009 |
| JP | 2009-509812 | A | 3/2009 |
| JP | 2009-160941 | | 7/2009 |
| JP | 2009-184832 | A | 8/2009 |
| JP | 2011-110843 | A | 6/2011 |
| JP | 2011-110845 | A | 6/2011 |
| JP | 2011-110848 | A | 6/2011 |
| WO | 03/080350 | | 10/2003 |
| WO | 2006/024913 | | 3/2006 |
| WO | 2006/090842 | | 8/2006 |
| WO | 2009/107534 | A1 | 9/2009 |

OTHER PUBLICATIONS

Japanese Office Action of JP 2009-270056 dated Nov. 13, 2012.
Japanese Office Action of JP 2009-297502 dated Nov. 13, 2012.
Japanese Office Action in JP 2009-086239 on May 8, 2012.
Japanese Office Action in JP 2009-086222 on Jun. 12, 2012.
International Preliminary Report on Patentability in PCT/JP2010/055310 on Apr. 11, 2012.
International Preliminary Report on Patentability of PCT/JP2009/071812 dated Aug. 14, 2012.
Japanese Office Action of JP 2009-086172 dated Sep. 11, 2012.
Japanese Office Action of JP 2009-088449 dated Sep. 11, 2012.
European Communication of EP 10711477.9 dated Sep. 6, 2012.
NZ Examination Report of NZ 596044 dated Sep. 28, 2012.
International Preliminary Report on Patentability in PCT/JP2009/071568 on Nov. 15, 2011.
International Preliminary Report on Patentability in PCT/JP2010/055324 on Nov. 15, 2011.
International Preliminary Report on Patentability in PCT/JP2010/055326 on Nov. 15, 2011.
International Preliminary Report on Patentability in PCT/JP2010/050253 on Nov. 15, 2011.
Japanese Office Action of JP 2010-084500 dated Jul. 3, 2012.
Japanese Office Action of JP 2010-084501 dated Jul. 3, 2012.
Japanese Office Action of JP 2010-084502 dated Jul. 3, 2012.
Japanese Office Action in JP 2010-041323 on May 22, 2012.
Japanese Office Action in JP 2010-084499 on Jun. 12, 2012.
Japanese Office Action in JP 2008-331639 on Mar. 27, 2012.
Japanese Office Action in JP 2008-331638 on Mar. 27, 2012.
Japanese Office Action in JP 2009-156405 on Mar. 27, 2012.
Japanese Office Action in JP 2009-156406 on Mar. 27, 2012.
Japanese Office Action in JP 2009-156407 on Mar. 27, 2012.
Japanese Office Action in JP 2009-270221 on Mar. 27, 2012.
Office Action issued in Chinese Application No. 201110049743.4 on Mar. 24, 2014.

* cited by examiner

RIBBON GUIDE IN A TAPE CASSETTE

CROSS REFERENCE TO RELATED APPLICATIONS

The present application claims priority from Japanese Patent Application No. JP 2010-041323, which was filed on Feb. 26, 2010, the disclosure of which is incorporated herein by reference in its entirety.

TECHNICAL FIELD

The disclosure relates to a tape cassette with an improved travel performance of an ink ribbon.

BACKGROUND

In a tape cassette mounted in a tape printing apparatus, at printing, an ink ribbon is conventionally drawn out from a ribbon feed spool and travels on a print head of the tape printing apparatus.

It has become a rare case that misalignment or a crease occurs during travel of an ink ribbon, however, should some factor cause such misalignment or a crease, it will adversely affect the print quality resulting in such as a blurred print. Therefore, further improvement of travel performance of an ink ribbon has been awaited.

SUMMARY

The disclosure has been made to solve the above-described problem and has an object to provide a tape cassette capable of correcting misalignment or a crease which has occurred during travel of an ink ribbon.

To achieve the purpose of the disclosure, there is provided a tape cassette configured to be removably mounted onto a tape printing apparatus provided with a print head at a cassette mounting portion, wherein the tape cassette includes a cassette case main body, a ribbon feed spool housed in the cassette case main body, an ink ribbon wound around the ribbon feed spool, with an inked surface thereof facing inside, a head insertion portion being a space for the print head to be inserted into when the tape cassette is mounted in the cassette mounting portion, the head insertion portion passing through the cassette case main body vertically and extended along one side of the tape cassette, an arm portion including: a base end portion positioned in proximity of a feed portion at which the ink ribbon is drawn out from the ribbon feed spool, the base end portion supporting an arm main body projecting at the one side of the cassette case main body; and a top end portion provided with a discharge slot which opens toward the head insertion portion, wherein the ink ribbon travels in a predetermined direction which is a direction from the feed portion, passing through the discharge slot, toward the head insertion portion, a plurality of guide members, a first guide member being one of the plurality of guide members; provided between the feed portion and the discharge slot; and positioned on the discharge slot, or immediately before the discharge slot, on an upstream side in a travel direction of the ink ribbon, wherein the first guide member bends and guides travel of the ink ribbon in the predetermined direction while making contact with a reverse side of the inked surface of the ink ribbon, a second guide member being one of the plurality of guide members; provided between the feed portion and the discharge slot; and positioned on an upstream side in the travel direction of the ink ribbon with respect to the first guide member, wherein the second guide member bends and guides the travel of the ink ribbon in the predetermined direction while making contact with the reverse side of the inked surface of the ink ribbon, and a first upstream-side projecting piece portion provided at a center portion of the second guide member, the first upstream-side projecting piece portion projecting along a width direction of the ink ribbon which orthogonally crosses the travel direction of the ink ribbon.

To achieve the purpose of the disclosure, there is further provided a tape cassette configured to be removably mounted onto a tape printing apparatus provided with a print head at a cassette mounting portion, wherein the tape cassette includes a cassette case main body, a ribbon feed spool housed in the cassette case main body, an ink ribbon wound around the ribbon feed spool, with an inked surface thereof facing inside, a head insertion portion being a space for the print head to be inserted into when the tape cassette is mounted in the cassette mounting portion, the head insertion portion passing through the cassette case main body vertically and extended along one side of the tape cassette, an arm portion including: a base end portion positioned in proximity of a feed portion at which the ink ribbon is drawn out from the ribbon feed spool, the base end portion supporting an arm main body projecting at the one side of the cassette case main body; and a top end portion provided with a discharge slot which opens toward the head insertion portion, wherein the ink ribbon travels in a predetermined direction which is a direction from the feed portion, passing through the discharge slot, toward the head insertion portion, a plurality of guide members, a first guide member being one of the plurality of guide members; provided between the feed portion and the discharge slot; and positioned on the discharge slot, or immediately before the discharge slot, on an upstream side in a travel direction of the ink ribbon, wherein the first guide member bends and guides travel of the ink ribbon in the predetermined direction while making contact with a reverse side of the inked surface of the ink ribbon, a second guide member being one of the plurality of guide members; provided between the feed portion and the discharge slot; and positioned on an upstream side in the travel direction of the ink ribbon with respect to the first guide member, wherein the second guide member bends and guides the travel of the ink ribbon in the predetermined direction while making contact with the reverse side of the inked surface of the ink ribbon, a first upstream-side projecting piece portion provided at a center portion of the second guide member, the first upstream-side projecting piece portion projecting along a width direction of the ink ribbon which orthogonally crosses the travel direction of the ink ribbon, a downstream-side projecting piece portion provided at a center portion of the first guide member, the downstream-side projecting piece portion projecting along the width direction of the ink ribbon which orthogonally crosses the travel direction of the ink ribbon, and lower in height than the first upstream-side projecting piece portion, and a third guide member being one of the plurality of guide members and positioned on an upstream side in the travel direction of the ink ribbon with respect to the second guide member, wherein the third guide member bends and guides travel of the ink ribbon in the predetermined direction while making contact with the reverse side of the inked surface of the ink ribbon, wherein the second guide member is provided at the top end portion of the arm member and positioned on the upstream side in the travel direction of the ink ribbon with respect to the first guide member, and wherein the center portion of the third guide member is evenly-formed along the width direction of the ink ribbon which orthogonally crosses the travel direction of the ink ribbon.

DETAILED DESCRIPTION

Figure 7:
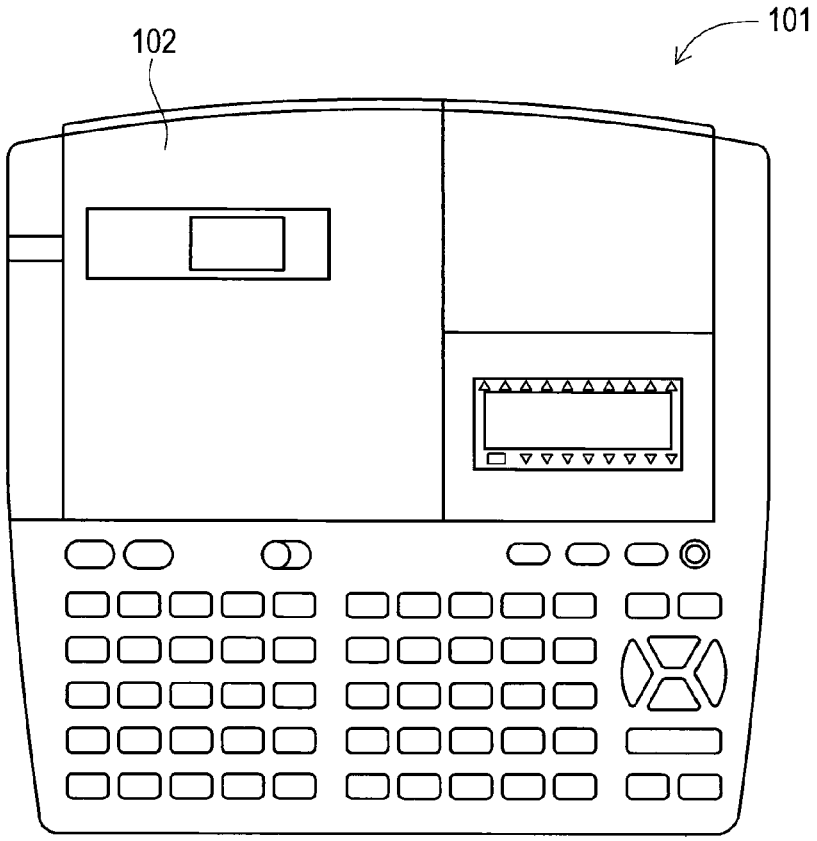
FIG. 7 is a plan view of a tape printing apparatus configured to removably receive the tape cassette.
Figure 8:
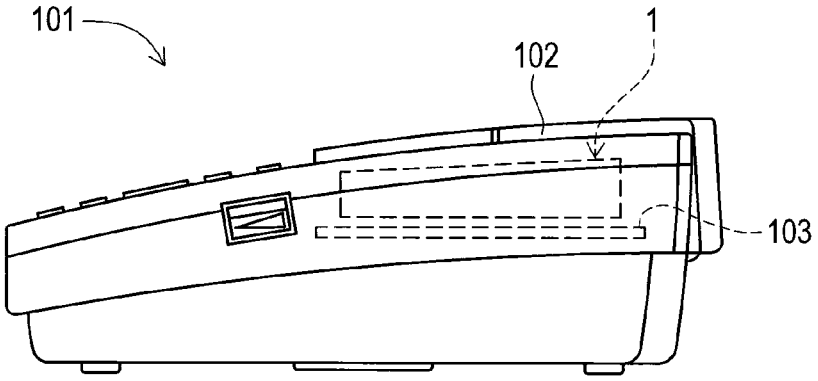
FIG. 8 is a side view of the tape printing apparatus.

A detailed description of an exemplary embodiment of a printing apparatus directed to the disclosure will now be given by referring to the accompanying drawings. As illustrated in FIGS. 7 and 8, a tape printing apparatus 101 is provided with a lid body 102 and a cassette mounting portion 103.

The cassette mounting portion 103 is covered with the lid body 102 when the lid body 102 is closed. However, the lid body 102 movably provided so that the lid body 102 can be opened or closed. Accordingly, if the lid body 102 is opened, the cassette mounting portion 103 is exposed.

With respect to the cassette mounting portion 103 which is exposed, a user can mount or dismount a tape cassette 1 directed to the present embodiment. Accordingly, by putting the tape cassette 1 directed to the present embodiment in the cassette mounting portion 103 and closing the lid body 102, the user can securely mount the tape cassette 1 directed to the present embodiment onto the cassette mounting portion 103 of the tape printing apparatus 101.

Figure 5:
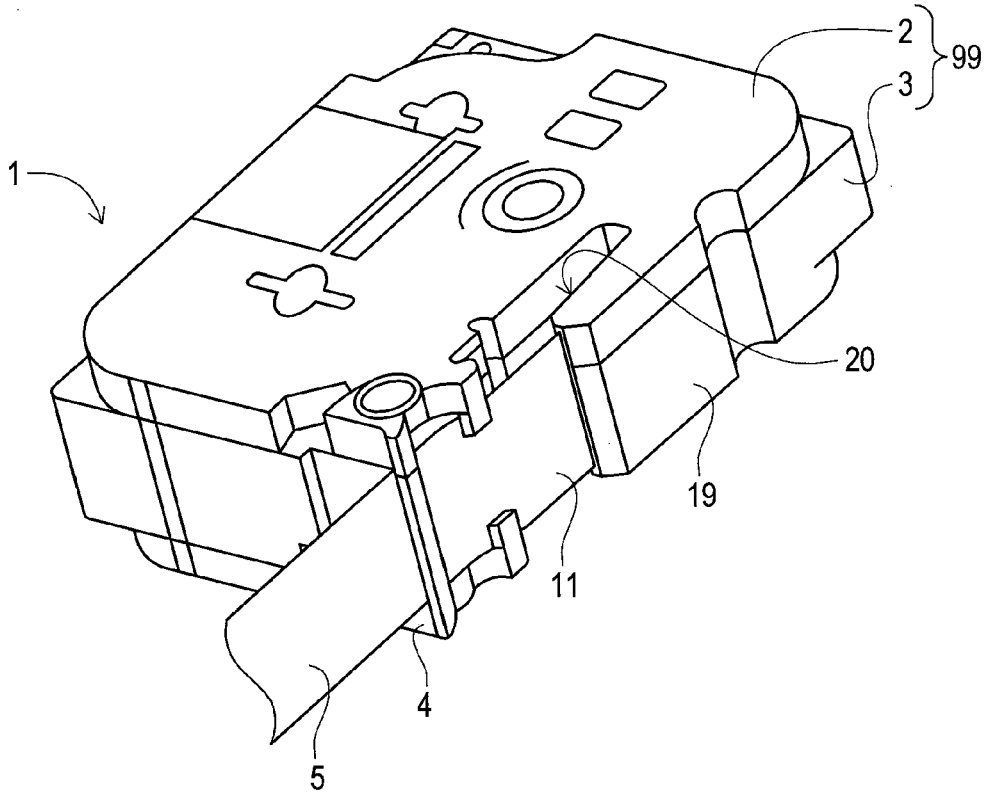
FIG. 5 is a perspective view of the tape cassette.

The tape cassette 1 directed to the present embodiment is for a so-called laminated type tape. As illustrated in FIG. 5, the tape cassette 1 directed to the present embodiment is provided with a cassette case main body 99 including an upper cassette case 2 and a lower cassette case 3. With respect to the tape cassette 1 directed to the present embodiment, a printed tape 5 is discharged from a tape discharge portion 4.

Reference numeral 11 refers to a laminating film (which is wound as a first tape). Reference numeral 19 refers to an arm portion. Reference numeral 20 refers to a head insertion portion. The detailed description with respect thereto will be given later.

Figure 6:
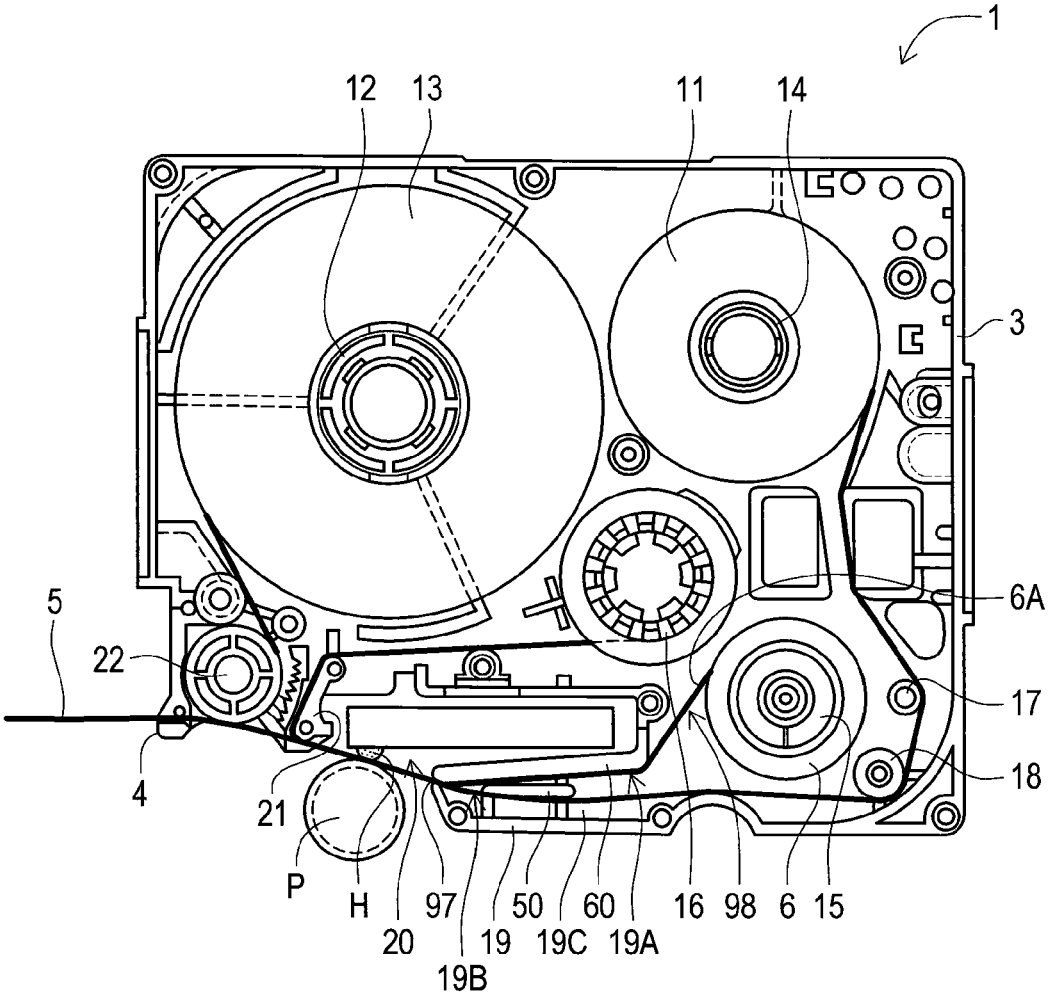
FIG. 6 is a plan view of the tape cassette when an upper cassette case is removed.

In FIG. 6, within the lower cassette case 3 of the tape cassette 1 directed to the present embodiment, a tape spool 12, a film spool 14, a ribbon feed spool 15 and a ribbon take-up spool 16 are arranged in a manner rotatable in cooperation with spool supporting portions (not illustrated) formed in the upper cassette case 2 (see FIG. 5), respectively. A second tape 13 is wound around the tape spool 12, the first tape 11 is wound around the film spool 14, and an ink ribbon 6 is wound around the ribbon feed spool 15.

The first tape 11 is formed by winding a laminating film made of transparent or translucent resin around the film spool 14, with the print surface thereof facing inside. The first tape (laminating film) 11 wound around the film spool 14 travels from a guide pin 17 erected at the lower cassette case 3 through a guide spindle 18, which is rotatable, and is guided into the arm portion 19. Further, the first tape (laminating film) 11 travels in a state where the print surface thereof is making contact with a second travel member 50, passes through a discharge slot 97 of the arm portion 19, and is exposed at the head insertion portion 20. The first tape (laminating film) 11 then passes over a first travel member 21 and a feed roller 22, and is discharged from the tape discharge portion 4 to the outside of the tape cassette 1 directed to the present embodiment.

The head insertion portion 20 is extended along the front face (right side surface in FIG. 5) of the tape cassette 1 directed to the present embodiment, and formed penetrating through the cassette case main body 99 (see FIG. 5) in a vertical direction. The arm portion 19 includes an arm main body 19C which includes a base end portion 19A and a top end portion 19B. The base end portion 19A is positioned in proximity of a feed portion 98 positioned right after the ink ribbon 6 is drawn out from the ribbon feed spool 15. Meanwhile, the top end portion 19B is provided with the discharge slot 97 which opens toward the head insertion portion 20.

The arm portion 19 has a cantilever structure, in which the arm main body 19C is supported at the side surface of the cassette case main body 99 (see FIG. 5). In the configuration, the base end portion 19A is a fixed end and the top end portion 19B is a free end. Accordingly, the base end portion 19A supports the arm main body 19C protruding from the side surface of the cassette case main body 99 (see FIG. 5).

Further, the ink ribbon 6 is wound around the ribbon feed spool 15 with the inked surface thereof, which is on an ink application side, facing inside. The ink ribbon 6 is drawn out from the ribbon feed spool 15. Right after that, through the feed portion 98, the ink ribbon 6 travels in a state where the reverse side 6A of the inked surface thereof makes contact with a third travel member 60, passes through the discharge slot 97 of the arm portion 19, and is exposed at the head insertion portion 20. In this manner, the ink ribbon 6 inside the arm portion 19 travels in a predetermined direction from the feed portion 98 through the discharge slot 97 to the head insertion portion 20. Then the ink ribbon 6 is guided so that the reverse side 6A of the inked surface thereof is put on the print surface of the first tape (laminating film) 11. Then the ink ribbon 6 is guided along the outer surface of the first travel member 21, and as a result, moves away from the print surface of the first tape (laminating film) 11, and is wound around the ribbon take-up spool 16.

When the tape cassette 1 directed to the present embodiment is mounted onto the cassette mounting portion 103 (see FIG. 8) of the tape printer 101 (see FIGS. 7 and 8), a print head H of the tape printer 101 (see FIG. 8) is inserted into the head insertion portion 20. The first tape (laminating film) 11 and the ink ribbon 6 are sandwiched between the print head H and a platen roller P of the tape printer 101 (see FIGS. 7 and 8) which is located opposite to the print head H.

Meanwhile, the second tape 13 is formed by winding a double-sided adhesive tape, which has a release sheet only on one side thereof, around the tape spool 13 with the other side of the double-sided adhesive tape facing inside. The second tape (double-sided adhesive tape having the release sheet) 13 thus wound is guided by the feed roller 22 so that an adhesive surface thereof is put on the print surface of the first tape (laminating film) 11. Then the second tape (double-sided adhesive tape having the release sheet) 13 and the first tape (laminating film) 11 are stuck together, and discharged from the tape discharge portion 4 to the outside of the tape cassette 1 directed to the present embodiment. Thereby, from the tape discharge portion 4 of the tape cassette 1 directed to the present embodiment, a so-called laminated type print tape 5 is discharged, which is made up of the first tape (laminating film) 11 and the second tape (double-sided adhesive tape having the release sheet) 13.

In the tape cassette 1 directed to the present embodiment, a plurality of guide ribs are provided on the third travel member 60 with which the reverse side 6A of the inked surface makes contact while the ink ribbon 6 is traveling.

Figure 1:
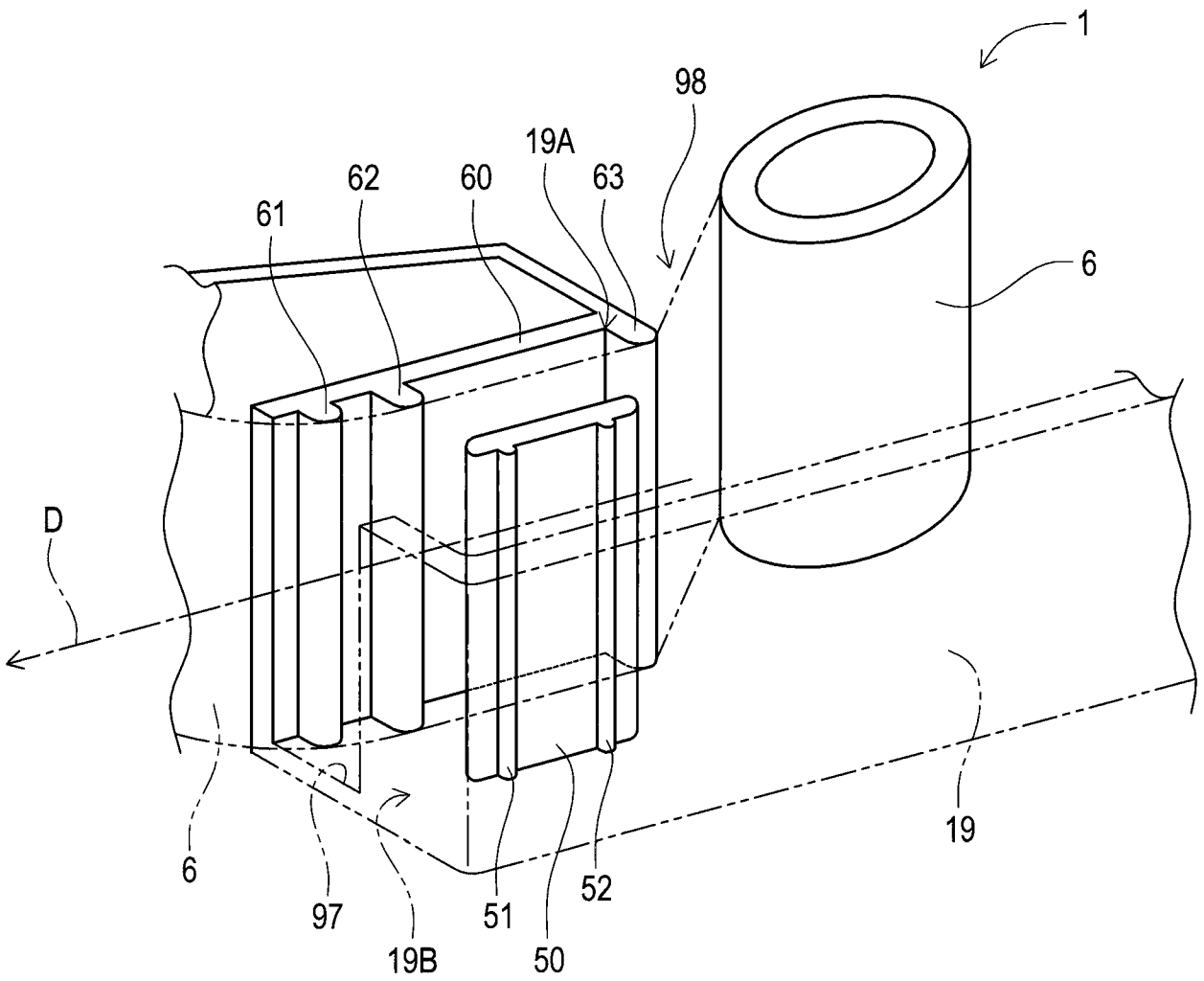
FIG. 1 is a perspective view schematically illustrating a travel state of an ink ribbon inside an arm portion included in a tape cassette directed to an embodiment of the present disclosure.

As illustrated in FIG. 1, in the tape cassette 1 directed to the present embodiment, at printing, the ink ribbon 6 travels in the predetermined direction D, from the feed portion 98, passing through the discharge slot 97, toward the head insertion portion 20 (see FIG. 6). Further, inside the arm portion 19 included in the tape cassette 1 directed to the present embodiment, three guide ribs 61, 62 and 63, each of which is linear shaped, are arranged in parallel in a direction orthogonal to the predetermined direction D (namely, a width direction of the ink ribbon 6) on the third travel member 60 with which the reverse side 6A (see FIG. 6) of the inked surface makes contact while the ink ribbon 6 is traveling.

A guide rib indicated by reference numeral 61 refers to a discharge-slot-side guide rib provided in proximity of the discharge slot 97 at the top end portion 19B of the arm portion 19. A guide rib indicated by reference numeral 63 refers to a feed-portion-side guide rib provided in proximity of the feed portion 98 near the base end portion 19A of the arm portion 19 and is first to bend and guide the travel of the ink ribbon 6 drawn out from the feed portion 98 in the predetermined direction. A guide rib indicated by reference numeral 62 is an intermediate guide rib provided between the discharge-slot-side guide rib 61 and the feed-portion-side guide rib 63, arranged closer to the discharge-slot-side guide rib 61 than the feed-portion-side guide rib 63. In the above, with respect to the third travel member 60, there has been described that the ink ribbon 6 travels while making the reverse side 6A (see FIG. 6) of the inked surface contact therewith, however, to be precise, the reverse side 6A (see FIG. 6) of the inked surface of the ink ribbon 6 makes contact with the three guide ribs 61, 62 and 63 thereof.

There are provided, as illustrated in FIG. 1, a pair of guide ribs 51, 52 arranged in parallel on the second travel member 50 with which the print surface of the first tape (laminating film) 11 (see FIG. 6) makes contact while traveling.

Figure 2:
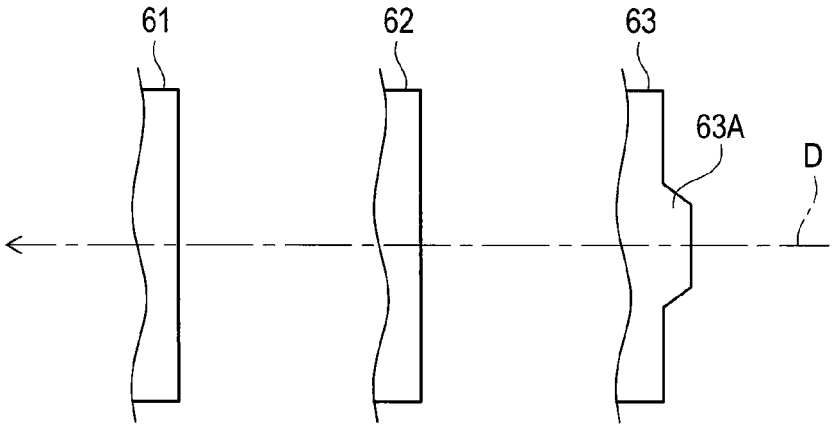
FIG. 2 is a side view illustrating an example of a combination with respect to shapes of three guide ribs for the ink ribbon included in the tape cassette.
Figure 3:
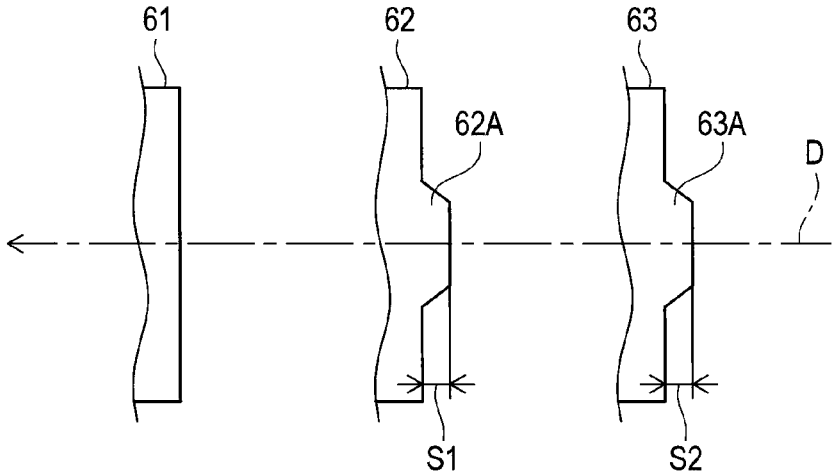
FIG. 3 is a side view illustrating an example of a combination with respect to shapes of three guide ribs for the ink ribbon included in the tape cassette.
Figure 4:
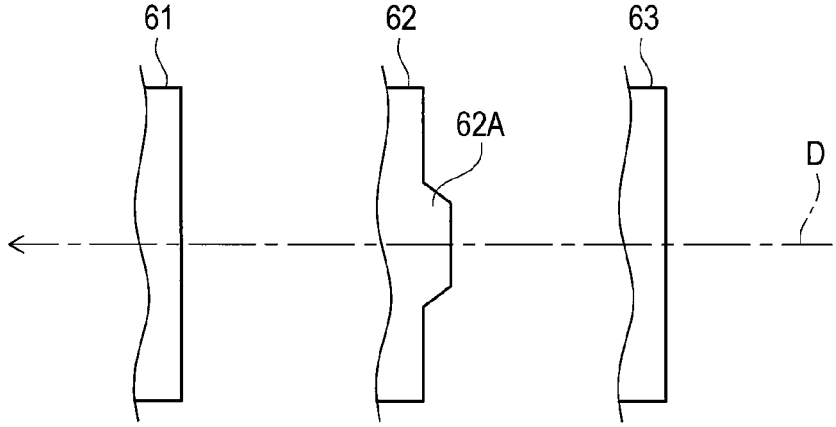
FIG. 4 is a side view illustrating an example of a combination with respect to shapes of three guide ribs for the ink ribbon included in the tape cassette.

As illustrated in FIGS. 2 through 4, the two of the three guide ribs, namely, guide ribs 62 and 63, may have convex portions 62A and 63A, respectively. In FIGS. 2 and 4, at the center portion of the feed-portion-side guide rib 63, there is provided the feed-portion-side convex portion 63A, in a manner projecting along the direction orthogonal to the predetermined direction D (namely, the width direction of the ink ribbon 6 (see FIG. 1)). In FIGS. 3 and 4, at the center portion of the intermediate guide rib 62, the intermediate convex portion 62A is provided, in a manner projecting along the direction orthogonal to the predetermined direction D (namely, the width direction of the ink ribbon 6 (see FIG. 1)).

However, as illustrated in FIG. 3, when providing both of the feed-portion-side convex portion 63A of the feed-portion-side guide rib 63 and the intermediate convex portion 62A of the intermediate guide rib 62, there can be assumed two cases; the first case and the second case. In the first case, the height S1 of the intermediate convex portion 62A of the intermediate guide rib 62 is set to be lower than the height S2 of the feed-portion-side convex portion 63A of the feed-portion-side guide rib 63. In the second case, the height S1 of the intermediate convex portion 62A of the intermediate guide rib 62 is set to be equal to or higher than the height S2 of the feed-portion-side convex portion 63A of the feed-portion-side guide rib 63.

Here will be described a case in which the shapes of the three guide ribs 61, 62 and 63 are of the combination as illustrated in FIG. 2. In this case, the ink ribbon 6 (see FIG. 1) is first bent and guided in the predetermined direction D while making contact with the feed-portion-side guide rib 63. The feed-portion-side convex portion 63A of the feed-portion-side guide rib 63 can, in this case, lead the travel of the ink ribbon 6 (see FIG. 1) toward the center portion of the feed-portion-side guide rib 63 even if the ink ribbon 6 is misaligned in the ink-ribbon-width direction. Thereby, misalignment in the travel of the ink ribbon 6 (see FIG. 1) in the ink-ribbon-width direction can be corrected, even if the misalignment should occur. Following this, the ink ribbon 6 (see FIG. 1) is bent and guided in the predetermined direction D while making contact with the intermediate guide rib 62 and the discharge-slot-side guide rib 61, in this order. Here, both of the intermediate guide rib 62 and the discharge-slot-side guide rib 61 are each in an even shape which does not have any convex portion, and accordingly, even if a crease occurs in the ink ribbon 6 (see FIG. 1), the intermediate guide rib 62 and the discharge-slot-side guide rib 61 can smooth out and correct the crease. In this case, because the intermediate guide rib 62 which corrects a crease is provided in proximity of the discharge-slot-side guide rib 61 which also corrects a crease (see FIG. 1), even if a crease occurs in the ink ribbon 6 (see FIG. 1), the crease of the ink ribbon 6 can be repeatedly corrected just before the ink ribbon 6 (see FIG. 1) passes through the discharge slot 97 (see FIG. 1) which is positioned in proximity of the print head H (see FIG. 6).

In this case, even if one of the intermediate guide rib 62 and the discharge-slot-side guide rib 61 is not provided, the crease occurred in the ink ribbon 6 (see FIG. 1) can still be corrected.

Next will be described a case in which the shapes of the three guide ribs 61, 62 and 63 are of the combination as illustrated in FIG. 3. Also in this case, the ink ribbon 6 (see FIG. 1) is first bent and guided in the predetermined direction D while making contact with the feed-portion-side guide rib 63. Also in this case, the feed-portion-side convex portion 63A of the feed-portion-side guide rib 63 can lead the travel of the ink ribbon 6 (see FIG. 1) toward the center portion of the feed-portion-side guide rib 63. Thereby, misalignment of the travel of the ink ribbon 6 (see FIG. 1) can be corrected, even if the misalignment of the travel occurs. Following this, the ink ribbon 6 (see FIG. 1) is bent and guided in the predetermined direction D while making contact with the intermediate guide rib 62. However, in this case, the intermediate convex portion 62A is provided on the intermediate guide rib 62. In the first case as described above, though, the height S1 thereof is set to be lower than the height S2 of the feed-portion-side convex portion 63A of the feed-portion-side guide rib 63, therefore, if a crease should occur in the ink ribbon 6 (see FIG. 1) by the contact with the feed-portion-side convex portion 63A of the feed-portion-side guide rib 63, the intermediate convex portion 62A of the intermediate guide rib 62 can smooth out and correct the crease. Following this, the ink ribbon 6 (see FIG. 1) is bent and guided in the predetermined direction D while making contact with the discharge-slot-side guide rib 61. Here, the discharge-slot-side guide rib 61 is in an even shape which does not have any convex portion, and accordingly, even if a crease occurs in the ink ribbon 6 (see FIG. 1), the discharge-slot-side guide rib 61 can smooth out and correct the crease. In this case, because the intermediate guide rib 62 which corrects a crease is provided in proximity of the discharge-slot-side guide rib 61 which also corrects a crease (see FIG. 1), even if a crease occurs in the ink ribbon 6 (see FIG. 1), the crease of the ink ribbon 6 (see FIG. 1) can be repeatedly corrected just before the ink ribbon 6 (see FIG. 1) passes through the discharge slot 97 (see FIG. 1) which is positioned in proximity of the print head H (see FIG. 6).

Also in this case, even if one of the intermediate guide rib 62 and the discharge-slot-side guide rib 61 is omitted, the crease occurred in the ink ribbon 6 (see FIG. 1) can still be corrected.

Meanwhile, in a case where the shapes of the three guide ribs 61, 62 and 63 are of the combination as illustrated in FIG. 3, in the second case above, the height S1 of the intermediate convex portion 62A of the intermediate guide rib 62 is set to be equal to or higher than the height S2 of the feed-portion-side convex portion 63A of the feed-portion-side guide rib 63. Therefore, the intermediate convex portion 62A of the intermediate guide rib 62 can lead the travel of the ink ribbon 6 (see FIG. 1) toward the center portion of the intermediate guide rib 62 in the same manner as the feed-portion-side convex portion 63A of the feed-portion-side guide rib 63. Thereby, in this case, as both of the feed-portion-side guide rib 63 and the intermediate guide rib 62 correct misalignment of the ink ribbon 6 (see FIG. 1), the misalignment of the ink ribbon 6 (see FIG. 1) can be corrected at two locations, just after the ink ribbon 6 (see FIG. 1) is drawn out of the ribbon feed spool 15 (see FIG. 6), and just before the ink ribbon 6 (see FIG. 1) passes through the discharge slot 97 (see FIG. 1).

Finally, here will be described a case in which the shapes of the three guide ribs 61, 62 and 63 are of the combination as illustrated in FIG. 4. Also in this case, the ink ribbon 6 (see FIG. 1) is first bent and guided in the predetermined direction D while making contact with the feed-portion-side guide rib 63. Here, the feed-portion-side guide rib 63 is in an even shape which does not have any convex portion, and therefore, even if a crease occurs in the ink ribbon 6 (see FIG. 1), the feed-portion-side guide rib 63 can smooth out and correct the crease. Following this, the ink ribbon 6 (see FIG. 1) is bent and guided in the predetermined direction D while making contact with the intermediate guide rib 62. The intermediate convex portion 62A of the intermediate guide rib 62 can, in this case, lead the travel of the ink ribbon 6 (see FIG. 1) toward the center portion of the intermediate guide rib 62. Thereby, misalignment of the ink ribbon 6 (see FIG. 1) can be corrected, even if the misalignment occurs. Following this, the ink ribbon 6 (see FIG. 1) is bent and guided in the predetermined direction D while making contact with the discharge-slot-side guide rib 61. Here, the discharge-slot-side guide rib 61 is in an even shape which does not have any convex portion, even if a crease occurs in the ink ribbon 6 (see FIG. 1), the discharge-slot-side guide rib 61 can smooth out and correct the crease. In this case, because the intermediate guide rib 62 which corrects misalignment of the travel is provided in proximity of the discharge-slot-side guide rib 61 which corrects a crease (see FIG. 1), even if a crease or misalignment of the travel occurs in the ink ribbon 6 (see FIG. 1), the misalignment of the travel or the crease of the ink ribbon 6 can be corrected just before the ink ribbon 6 (see FIG. 1) passes through the discharge slot 97 (see FIG. 1) which is positioned in proximity of the print head H (see FIG. 6). Further, in this case, both of the feed-portion-side guide rib 63 and the discharge-slot-side guide rib 61 correct the crease of the ink ribbon 6 (see FIG. 1), the crease of the ink ribbon 6 (see FIG. 1) can be corrected at two locations, just after the ink ribbon 6 is drawn out of the ribbon feed spool 15 (see FIG. 6), and just before the ink ribbon 6 (see FIG. 1) passes through the discharge slot 97 (see FIG. 1).

However, in this case, even if the feed-portion-side guide rib 63 is not provided, the crease occurred in the ink ribbon 6 (see FIG. 1) can be corrected just before the ink ribbon 6 (see FIG. 1) passes through the discharge slot 97 (see FIG. 1) by the discharge-slot-side guide rib 61.

While presently exemplary embodiments of the present disclosure have been shown and described, it is to be understood that this disclosure is for the purpose of illustration and that various changes and modifications may be made without departing from the scope of the disclosure as set forth in the appended claims.

For instance, in FIG. 1, the feed-portion-side guide rib 63 is provided at the end portion, which is the position closest to the feed portion 98 in the third travel member 60. Accordingly, in the cases of FIG. 2 and FIG. 3, misalignment during the travel of the ink ribbon 6 can be corrected at further upstream side in the predetermined direction D which is the travel direction of the ink ribbon 6. Alternatively, in the case of FIG. 4, a crease of the ink ribbon 6 can be smoothed out and corrected at further upstream side in the predetermined direction D which is the travel direction of the ink ribbon 6. Here, the feed-portion-side guide rib 63 can be provided at a position further deeper in the predetermined direction D, on the third travel member 60.

Further, as illustrated in FIG. 1, the discharge-slot-side guide rib 61 is provided in proximity of the discharge slot 97 at the top end portion 19B of the arm portion 19 (in proximity of the opposite side to the predetermined direction D, with respect to the discharge slot 97), however, the discharge-slot-side guide rib 61 may be provided on the discharge slot 97 itself. In this case, even if a crease occurs in the ink ribbon 6, the crease of the ink ribbon 6 can be smoothed out by the discharge-slot-side guide rib 61 when the ink ribbon 6 passes through the discharge slot 97 positioned in proximity of the print head H.

Further, in FIG. 1, the intermediate guide rib 62 is arranged in a position closer to the discharge-slot-side guide rib 61 than to the feed-portion-side guide rib 63, however, the intermediate guide rib 62 may be arranged in a position closer to the feed-portion-side guide rib 63.

Further, in FIG. 1, the three linear-shaped guide ribs 61, 62 and 63 are arranged in parallel in the direction orthogonal to the predetermined direction D (namely, the width direction of the ink ribbon 6) on the third travel member 60, however, four or more linear-shaped guide ribs may be arranged in parallel in the direction orthogonal to the predetermined direction D (namely, the width direction of the ink ribbon 6) on the third travel member 60.

Further, the tape cassette 1 directed to the present embodiment is of a so-called laminated type, however, the tape cassette 1 may be of a so-called receptor type.

What is claimed is:

1. A tape cassette, with a ribbon guide, configured to be removably mounted onto a tape printing apparatus provided with a print head at a cassette mounting portion, wherein the tape cassette comprises:

a cassette case main body;

a ribbon feed spool housed in the cassette case main body;

an ink ribbon wound around the ribbon feed spool, with an inked surface thereof facing inside;

a head insertion portion being a space for the print head to be inserted into when the tape cassette is mounted in the cassette mounting portion, the head insertion portion passing through the cassette case main body vertically and extended along one side of the cassette case main body;

an arm portion including: a base end portion positioned in proximity of a feed portion at which the ink ribbon is drawn out from the ribbon feed spool, the base end portion supporting an arm main body projecting at the one side of the cassette case main body; and a top end portion provided with a discharge slot which opens toward the head insertion portion, wherein the ink ribbon travels in a predetermined direction which is a direction from the feed portion, passing through the discharge slot, toward the head insertion portion;

a plurality of guide fibs;

a first guide rib being one of the plurality of guide fibs; provided between the feed portion and the discharge slot; and positioned on the discharge slot, or immediately before the discharge slot, on an upstream side in a travel direction of the ink ribbon, wherein the first guide rib bends and guides travel of the ink ribbon in the predetermined direction while making contact with a reverse side of the inked surface of the ink ribbon, and is evenly-formed along a width direction of the ink ribbon which orthogonally crosses the travel direction of the ink ribbon;

a second guide rib being one of the plurality of guide ribs; provided between the feed portion and the discharge slot; and positioned on an upstream side in the travel direction of the ink ribbon with respect to the first guide rib, wherein the second guide rib bends and guides the travel of the ink ribbon in the predetermined direction while making contact with the reverse side of the inked surface of the ink ribbon, and is evenly-formed along the width direction of the ink ribbon which orthogonally crosses the travel direction of the ink ribbon except for a center portion of the second guide rib;

a third guide rib being one of the plurality of guide ribs, provided between the feed portion and the discharge slot, and positioned on a downstream side in the travel direction of the ink ribbon with respect to the first guide rib, wherein the third guide ribs bends and guides the travel of the ink ribbon in the predetermined direction while making contact with the reverse side of the inked surface of the ink ribbon, and is evenly-formed along the width direction of the ink ribbon which orthogonally crosses the travel direction of the ink ribbon; and a first upstream-side projecting piece portion provided only at the center portion of the second guide rib, the first upstream-side projecting piece portion being a stepped portion having a trapezoidal cross section projecting along the width direction of the ink ribbon which orthogonally crosses the travel direction of the ink ribbon.

2. The tape cassette according to claim 1, wherein the second guide rib is provided at the base end portion of the arm portion, and is first to bend and guide the travel of the ink ribbon drawn out from the feed portion in the predetermined direction.

3. A tape cassette, with a ribbon guide, configured to be removably mounted onto a tape printing apparatus provided with a print head at a cassette mounting portion, wherein the tape cassette comprises:

a cassette case main body;

a ribbon feed spool housed in the cassette ease main body;

an ink ribbon wound around the ribbon feed spool, with an inked surface thereof facing inside;

a head insertion portion being a space for the print head to be inserted into when the tape cassette is mounted in the cassette mounting portion, the head insertion portion passing through the cassette case main body vertically and extended along one side of the cassette case main body;

an arm portion including: a base end portion positioned in proximity of a feed portion at which the ink ribbon is drawn out from the ribbon feed spool, the base end portion supporting an arm main body projecting at the one side of the cassette case main body; and a top end portion provided with a discharge slot which opens toward the head insertion portion, wherein the ink ribbon travels in a predetermined direction which is a direction from the feed portion passing through the discharge slot, toward the head insertion portion;

a plurality of guide ribs;

a first guide rib being one of the plurality of guide ribs, provided between the feed portion and the discharge slot, and positioned on the discharge slot, or immediately before the discharge slot, on an upstream side in a travel direction of the ink ribbon, wherein the first guide rib bends and guides travel of the ink ribbon in the predetermined direction while making contact with a reverse side of the inked surface of the ink ribbon, and is evenly-formed along a width direction of the ink ribbon which orthogonally crosses the travel direction of the ink ribbon except for a center portion of the first guide rib;

a second guide rib being one of the plurality of guide ribs, provided between the feed portion and the discharge slot, and positioned on an upstream side in the travel direction of the ink ribbon with respect to the first guide rib, wherein the second guide rib bends and guides the travel of the ink ribbon in the predetermined direction while making contact with the reverse side of the inked surface of the ink ribbon, and is evenly-formed along the width direction of the ink ribbon which orthogonally crosses the travel direction of the ink ribbon except for a center portion of the second guide rib;

a third guide rib being one of the plurality of guide ribs, provided between the feed portion and the discharge slot, and positioned on a downstream side in the travel direction of the ink ribbon with respect to the first guide rib, wherein the third guide rib bends and guides the travel of the ink ribbon in the predetermined direction while making contact with the reverse side of the inked surface of the ink ribbon, and is evenly-formed along the width direction of the ink ribbon which orthogonally crosses the travel direction of the ink ribbon;

a first upstream-side projecting piece portion provided at the center portion of the second guide rib, the first upstream-side projecting piece portion being a stepped portion having a trapezoidal cross section projecting along the width direction of the ink ribbon which orthogonally crosses the travel direction of the ink ribbon; and a downstream-side projecting piece portion provided at a center portion of the first guide rib, the downstream-side projecting piece portion being a stepped portion having a trapezoidal cross section projecting along the width direction of the ink ribbon which orthogonally crosses the travel direction of the ink ribbon, and lower in height than the first upstream-side projecting piece portion.

4. The tape cassette according to claim 3, wherein the second guide rib is provided at the base end portion of the arm portion, and is first to bend and guide the travel of the ink ribbon drawn out from the feed portion in the predetermined direction.

5. A tape cassette, with a ribbon guide, configured to be removably mounted onto a tape printing apparatus provided with a print head at a cassette mounting portion, wherein the tape cassette comprises:

a cassette case main body;

a ribbon feed spool housed in the cassette case main body;

an ink ribbon wound around the ribbon feed spool, with an inked surface thereof facing inside;

a head insertion portion being a space for the print head to be inserted into when the tape cassette is mounted in the cassette mounting portion, the head insertion portion passing through the cassette case main body vertically and extended along one side of the cassette case main body;

an arm portion including: a base end portion positioned in proximity of a feed portion at which the ink ribbon is drawn out from the ribbon feed spool, the base end portion supporting an arm main body projecting at the one side of the cassette case main body; and a top end portion provided with a discharge slot which opens toward the head insertion portion, wherein the ink ribbon travels in a predetermined direction which is a direction from the feed portion, passing through the discharge slot, toward the head insertion portion;

a plurality of guide ribs;

a first guide rib being one of the plurality of guide ribs, provided between the feed portion and the discharge slot, and positioned on the discharge slot, or immediately before the discharge slot, on an upstream side in a travel direction of the ink ribbon, wherein the first guide rib bends and guides travel of the ink ribbon in the predetermined direction while making contact with a reverse side of the inked surface of the ink ribbon, and is evenly-formed along a width direction of the ink ribbon which orthogonally crosses the travel direction of the ink ribbon except for a center portion of the first guide rib;

a second guide rib being one of the plurality of guide ribs, provided between the feed portion and the discharge slot, and positioned on an upstream side in the travel direction of the ink ribbon with respect to the first guide rib, wherein the second guide rib bends and guides the travel of the ink ribbon in the predetermined direction while making contact with the reverse side of the inked surface of the ink ribbon, and is evenly-formed along the width direction of the ink ribbon which orthogonally crosses the travel direction of the ink ribbon;

a third guide rib being one of the plurality of guide ribs, provided between the feed portion and the discharge slot, and positioned on a downstream side in the travel direction of the ink ribbon with respect to the first guide rib, wherein the third guide rib bends and guides the travel of the ink ribbon in the predetermined direction while making contact with the reverse side of the inked surface of the ink ribbon, and is evenly-formed along the width direction of the ink ribbon which orthogonally crosses the travel direction of the ink ribbon;

a downstream-side projecting piece portion provided only at the center portion of the first guide rib, the downstream-side projecting piece portion being a stepped portion having a trapezoidal cross section projecting along the width direction of the ink ribbon which orthogonally crosses the travel direction of the ink ribbon.

6. The tape cassette according to claim 5, wherein the second guide rib is provided at the base end portion of the arm portion, and is first to bend and guide the travel of the ink ribbon drawn out from the feed portion in the predetermined direction.

* * * * *